US007350728B2

(12) United States Patent
Tempesta et al.

(10) Patent No.: US 7,350,728 B2
(45) Date of Patent: Apr. 1, 2008

(54) REFINING PLATE ATTACHED TO A HEAD IN A PULP REFINER

(75) Inventors: Nazareno T. Tempesta, Nashua, NH (US); Gilles P. Skilling, Nashua, NH (US); Kent P. Albert, Nashua, NH (US)

(73) Assignee: GLV Finance Hungary Kft., Luxembourg (LU)

( * ) Notice: Subject to any disclaimer, the term of this patent is extended or adjusted under 35 U.S.C. 154(b) by 695 days.

(21) Appl. No.: 10/919,621

(22) Filed: Aug. 17, 2004

(65) Prior Publication Data

US 2006/0037728 A1 Feb. 23, 2006

(51) Int. Cl.
*B02C 7/12* (2006.01)

(52) U.S. Cl. ..... 241/298; 241/261.2

(58) Field of Classification Search ..... 241/261.2, 241/261.3, 296–298
See application file for complete search history.

(56) References Cited

U.S. PATENT DOCUMENTS 3,117,603 A * 1/1964 Van Keuren et al. ..... 241/298
3,326,480 A * 6/1967 Jones ..... 241/298
4,005,827 A 2/1977 Frair et al. ..... 241/261.3
4,081,147 A 3/1978 Seifert et al. ..... 241/261.2
4,171,101 A 10/1979 Seifert et al. ..... 241/30
4,274,602 A 6/1981 Johansson
4,355,768 A 10/1982 Johansson ..... 241/261.3
4,610,400 A 9/1986 Sjobom ..... 241/261.2
4,619,414 A 10/1986 Kirchner et al. ..... 241/261.3
5,449,122 A 9/1995 Berger et al. ..... 241/261.2
5,526,992 A 6/1996 Hawen et al. ..... 241/298
5,707,019 A 1/1998 Aikawa ..... 241/261.2
5,934,585 A 8/1999 Chaney ..... 241/298
5,979,809 A 11/1999 Bartels et al. ..... 241/261.3

* cited by examiner

*Primary Examiner*—Mark Rosenbaum
(74) *Attorney, Agent, or Firm*—James Earl Lowe, Jr.

(57) ABSTRACT

A refiner plate has an outer circumferential edge, a front surface having comminuting projections, and a rear surface. The refiner plate also has and a single mounting opening radially inward from the outer circumferential edge. The refiner plate also includes a radially extending key attached to the rear surface, the key having an end forming a tab that extends past the plate outer circumferential edge.

14 Claims, 4 Drawing Sheets

REFINING PLATE ATTACHED TO A HEAD IN A PULP REFINER

BACKGROUND OF THE INVENTION

This invention is directed to pulp refiners, and, more particularly, to the mechanism used for attaching a refining plate to its supporting head.

Some refiners for wood pulp or the like, have stationary refining plates that flank rotary refining plates in the chamber of a housing whose inlet admits stock for treatment by comminuting projections (e.g., ribs) on the neighboring surfaces of stationary refining plates and rotary refining plates. Currently, the set of refining plates that are mounted to the rotating and stationary heads use four or more fasteners for each refiner plate. Mounting holes are normally located in the refining area of the plates, thus reducing the useful refining surface. The plates fit against an outer ring at the outside diameter of the head. The outer ring contains the plates in proper location and prevents outward movement due to centrifugal forces. The fasteners are designed to carry all the torsional forces acting on the refiner plates that occur during operation, while the outer ring carries all the centrifugal forces. In setting the plates against the outer ring, the plates are equally spaced around the head in the circumferential direction, with minimal space between each plate. However, due to manufacturing tolerances, openings can be created between the plates, and these openings can result in corrosive or erosive attack on the head mounting surfaces. Installing or replacing plates is very time consuming, and is dependent on the number of fasteners that need to be removed or installed.

SUMMARY OF THE INVENTION

The refiner plate of this invention is designed with a radial key that is attached to the plate's rear mounting surface. This radial key carries all torsional forces that act on the plates. At the outer end of the key, a tab is used to attach the plate to its supporting head. The plates are butted against a lip or ring on the outer circumference of the supporting plate, so that the ring carries all centrifugal forces. Near the inner end of the key, a fastener is installed in an opening passing through the plate and its supporting head. The combination of the fastener and the tab are used to hold the refiner plates in position. The fasteners and tabs are only used to locate the plates. They do not carry any radial or circumferential loads.

The fasteners are located outside the refining area of the plates, resulting in a significant increase in refining surface. Since there is only two fasteners per plate, the time to install and/or replace plates is significantly reduced. The plates are manufactured to tight tolerances, so that when a set of plates is installed, each plate is angled into position without requiring any radial movement. This helps to insure that minimal gap occur between the plates. The tight tolerances increase the cost of the refiner plates, but the savings realized due to fewer holes in the plates and fewer tapped holes in the heads, as well as savings in assembly and disassembly, more than offset the increased costs.

More particularly, the invention comprises a refiner plate having an outer circumferential edge, a front surface having comminuting projections, and a rear surface. The refiner plate also has a mounting opening radially inward from the outer circumferential edge. The refiner plate also includes a radially extending key attached to the rear surface, the key having an end forming a tab that extends past the plate outer circumferential edge.

Figure 1:
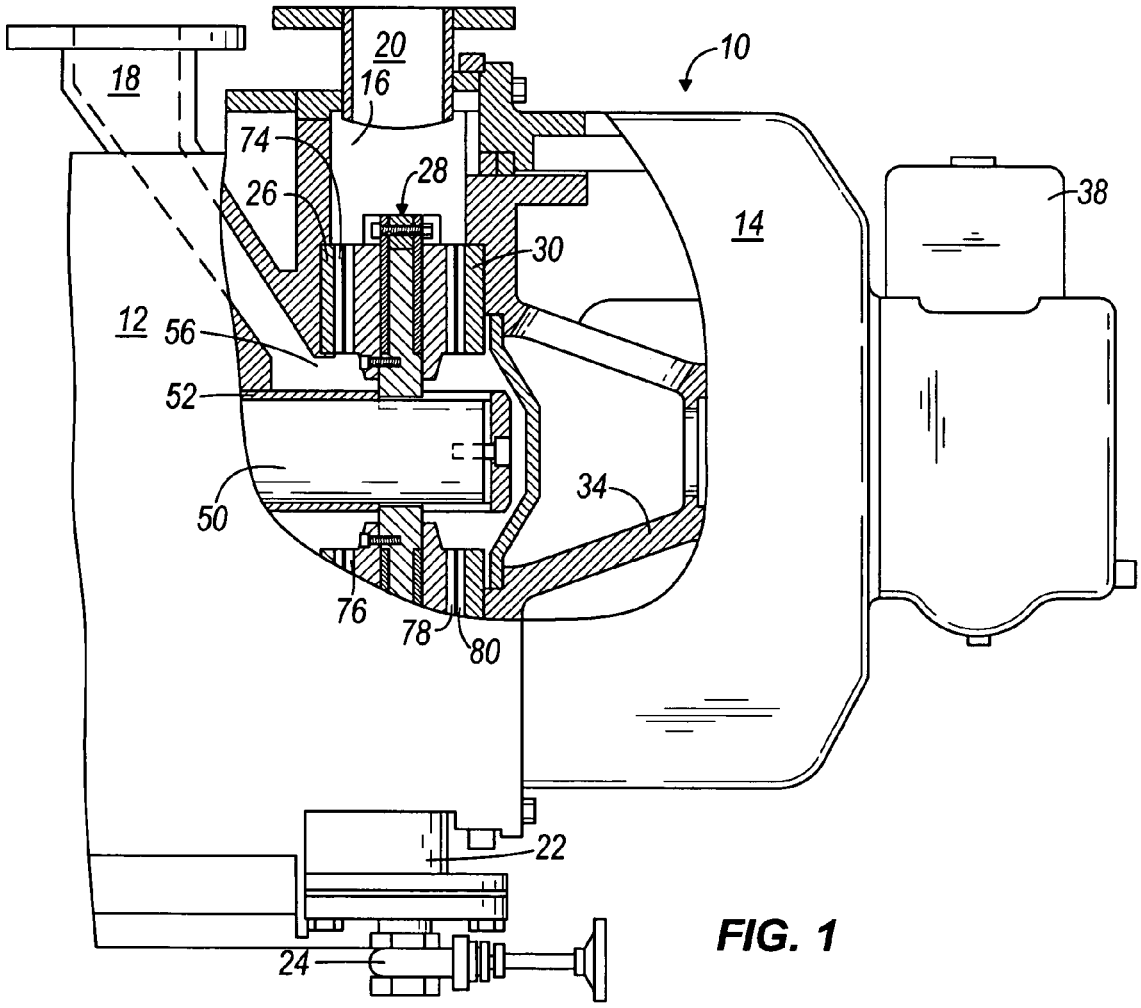
FIG. 1 is a fragmentary longitudinal vertical sectional view of a refiner in accordance with this invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience in reference to the drawings and are not to be construed as limiting terms.

DETAILED DESCRIPTION OF THE PREFERRED EMBODIMENT

As illustrated in FIG. 1, the invention provides a disc refiner having a housing 10 including several bolted-together sections, two of which are shown at 12 and 14. The housing defines a stock chamber 16 and has an inlet 18 for admission of pulp, a first outlet 20 for evacuation of the refined pulp, at least in part under the action of centrifugal force, and a second outlet 22 that is normally closed by a suitable valve 24. The outlet 20 extends upwardly and the outlet 22 extends downwardly. The valve 24 is opened when the attendants wish to drain the liquid carrier for wood chips or the like from the chamber 16. Although a particular housing geometry is shown, no particular housing construction is required.

The chamber 16 accommodates three refining members 26, 28, and 30, here shown as coaxial discs having identical outer diameters. In other embodiments (not shown), two back-to-back discs can be used instead of the single disc 28. In still other embodiments (not shown), just two refining members can be used. The disc 26 is stationary and is fixedly secured to the housing section 12 by screws (not shown) or analogous fasteners. The disc 30 also does not rotate. This disc is spaced apart from the disc 26 and is secured to an axially movable support 34 by means of screws (not shown) or the like. The support 34 is mounted in the housing section 14 and is movable axially of the discs 26, 28 by a reversible electric motor 38. The disc 28 is rotatable relative to and is movable axially between the discs 26 and 30. The means for rotating the disc 28 comprises a drive shaft 50 that rotates in a bearing 52 mounted in the housing section 12.

The disc 26 has a relatively large central opening 56 that communicates with the inlet 18 and surrounds the shaft 50 with a substantial amount of clearance. The end portion of the shaft 50 that extends beyond the opening 56 and into the central part of the chamber 16 drives the disc 28 in a conventional manner.

The space between the discs 26 and 28 and the space between the discs 28 and 30, respectively, define first and second paths along which the pulp can advance from the inlet 18 toward the first outlet 20 (the second outlet 22 is assumed to be sealed when the refiner is in use). The first path is flanked by rib-shaped comminuting projections 74, 76 of the discs 26, 28, and the second path is flanked by rib-shaped comminuting projections 78, 80 of the discs 28, 30. The opening 56 of the disc 26 admits pulp from the inlet 18 into the central portion of the first path, and such pulp flows radially outwardly between the projections 74 and 76 toward the outlet 20.

Figure 2:
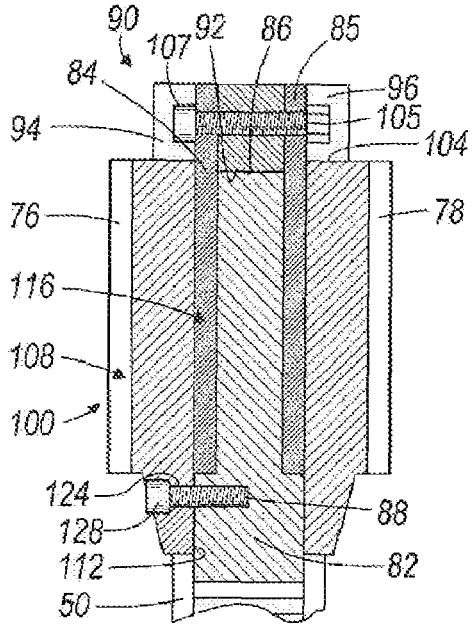
FIG. 2 is a cross sectional view of the top half of the central refining member or disc shown in FIG. 1.
Figure 3:
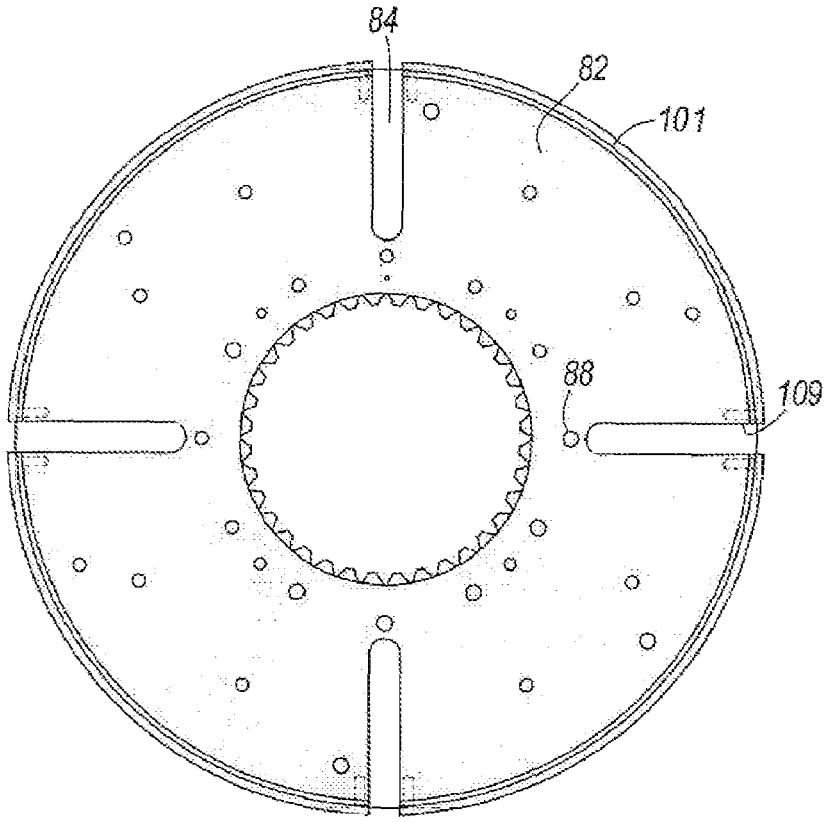
FIG. 3 is a front view of the refiner plate holding head of FIG. 2.

As best shown in FIG. 2, this invention provides a refining member for the refiner, the refining member, being, for example, the disc 28. More particularly, the refining member 28 comprises a head 82 having a plurality of radially extending slots 84 (see FIGS. 2 and 3), an outer circumferential edge 86, and a mounting hole 88 spaced radially inwardly from the outer circumferential edge 86.

The refining member 28 further includes, as shown in FIGS. 1 and 2, a device 90 outside of and attached to the head circumferential edge 86 and extending beyond the head outer circumferential edge in the direction of axial rotation of the head. More particularly, the devices are a plurality of retainers 90 (see FIGS. 2 and 7) spaced apart around and attached to the outer circumference of the supporting head 82. Although not shown in FIG. 3, which illustrates only the head 82, a retainer 90 is attached to the head 82 at the end of each of the slots 84.

Figure 7:
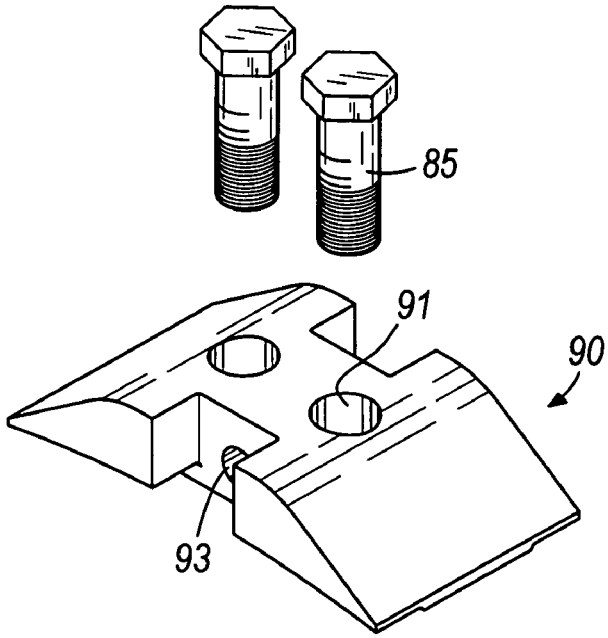
FIG. 7 is an exploded perspective view of one of the retainers used to secure the outer edge of the refiner plates to its supporting head.

As best seen in FIG. 7, each retainer 90 includes a top having a central flat and ends that slope downward away from the central flat, and a bottom 92 (see FIG. 2). The flat has two spaced apart holes 91, that pass through the retainer 90, for receiving threaded bolts 85 that secure the retainer 90 to the outer circumference of the supporting head 82. The retainer 90 also has two opposed sides, and an opening 93 that passes between the sides and through the retainer 90 between and perpendicular to the bolt holes 91. The sides of the retainer 90 extend beyond the head outer circumferential edge in the direction of axial rotation of the head in both the face and rear directions.

As best shown in FIGS. 2, 4, 5 and 6, the refining member 28 further includes a plurality (not shown, but four, in this instance) of refiner plates 100, each plate 100 having an outer circumferential edge 104 and including comminuting projections. Although the refining member 28 is described in detail, the discs 26 and 30 are similarly constructed (but not shown), with refiner plates 100 mounted on stationary heads with slots 84. On the stationary discs 26 and 30, the head outer circumferential edge is where the outer edges of the refiner plates are located.

More particularly, as shown in FIGS. 1 and 2, the head 82 supports refiner plates 100 on both the front and the rear surfaces of the head 82. Although, in this embodiment, the head slots 85 on the rear of the head 82 are aligned with the slots 84 on the front of the head 82, in other embodiments (not shown), the front slots 84 can be offset circumferentially from the rear slots 85.

For the remainder of this description, the refiner plate 100 shown on the left in FIG. 2 will be described in greater detail. This description is equally applicable to any of the other refiner plates.

Figure 4:
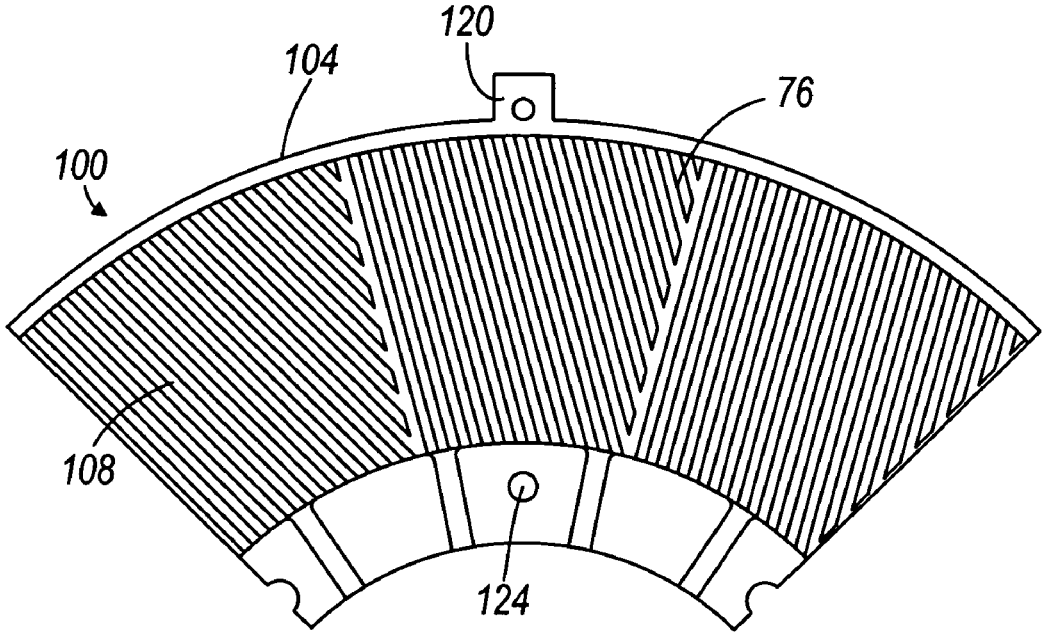
FIG. 4 is a front view of a refiner plate in accordance with this invention.
Figure 5:
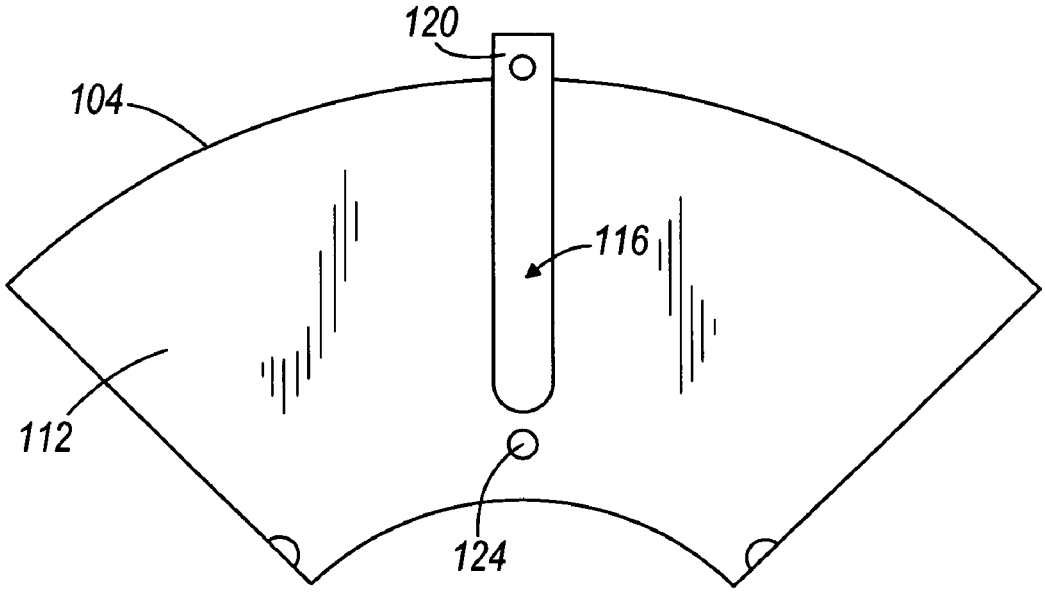
FIG. 5 is a rear view of the refiner plate shown in FIG. 4.
Figure 6:
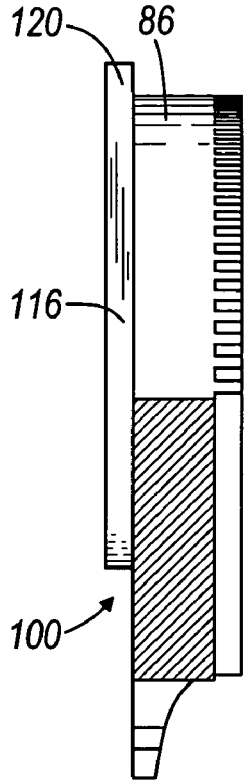
FIG. 6 is a side view of the refiner plate shown in FIG. 4.

As shown in FIGS. 2, 4 and 6, each of the refiner plates 100 has a main body having a front surface 108 having comminuting projections 76, and a rear surface 112. Each refiner plate 100 also includes a radially extending key 116 fixedly attached to the plate rear surface 112 and received in a respective one of the plurality of head slots 84 and 85. For example, the key 116 can be attached to the plate rear surface by welding, or it can be an integral part of the plate 100. Each key 116 has an end that forms a tab 120 that extends past the plate outer circumferential edge 104. The sides of the retainer 90 are notched in order to receive the tab 120 and to surround the head of a fastener 107 (see FIG. 2) that releasably secures the tab 120 to the retainer 90. The notched sides of the retainer 90 also help prevent side-to side movement of the tab 120 and the plate 100 relative to the head 82.

Each plate 100 is held against radially outward movement by a lip or ring 101 (see FIG. 3) around the outer circumference of the head 82. Notches 109 in the lip 108 permit the tab 120 to extend past the outer circumference of the head 82. In less preferred embodiments of the invention (not shown), the lip 101 could be omitted, and the plate outer circumferential edge 104 could abut the bottom of the sides of the retainer 90.

A mounting opening 124 radially inward from the comminuting projections 76 in the refiner plate 100 is aligned with the head-mounting hole 88, and a fastener 128 extends through the plate mounting opening 124 into the head-mounting hole 88 to removably secure the refining plate 100 to the head 82.

The refiner plates 100 are thus attached to the disc head 82 in the following manner. The four retainers 90 are secured to the outer circumference of the supporting head 82. Then the plates 100 are placed on the head 82, with the keys 116 being placed in the head slots 84. A fastener 128 is then used to releasably secure each plate 100 to the head 82, and a fastener 107 is passed through a plate tab 120 on the front of the head 82 and into the retainer 90. Similarly, a fastener 128 and a fastener 105 are used to attach a refiner plate 100 to the rear of the head 82.

Various other features and advantages of the invention will be apparent from the following claims.

The invention claimed is:

1. A refining member adapted for use in a refiner comprising a housing having a chamber, a material-admitting inlet and an outlet, two spaced apart coaxial refining members mounted in said chamber, with at least one refining member rotatable relative to said other refining member, and a path for the movement of material from said inlet to said outlet, said two refining members including comminuting projections adjacent to said path to refine the material flowing along said path, said refining member being at least one of said two refining members and comprising a head having a plurality of radially extending slots, an outer circumferential edge, and a mounting hole spaced radially inwardly from said outer circumferential edge, a device outside of and attached to said head circumferential edge, and a plurality of refiner plates, each of said refiner plates having an outer circumferential edge, a front surface having comminuting projections, and a plate rear surface, and a mounting opening radially inward from said outer circumferential edge and aligned with said head mounting hole, said refiner plate including a radially extending key attached to said plate rear surface and received in a respective one of said plurality of head slots, said key having an end forming a tab that extends past said plate outer circumferential edge, said tab being held by said device, and a fastener extending through said plate mounting opening into said head mounting hole to removably secure said refining plate to said head.

2. A refining member in accordance with claim 1 wherein said device extends beyond the head outer circumferential edge in the direction of axial rotation of the head, and the plate outer circumferential edge abuts said device.

3. A refining member in accordance with claim 1 wherein said tab is releasably secured to said device.

4. A refining member in accordance with claim 1 wherein each of said refiner plates has a single mounting opening.

5. A refining member in accordance with claim 1 wherein said mounting opening is radially inward from said comminuting projections.

6. A refining member in accordance with claim 1 wherein said head has a front face and a rear face, and wherein said head front face has therein a plurality of head slots and wherein said head rear face has therein a plurality of head slots.

7. A refining member in accordance with claim 6 wherein said plurality of head slots on the rear face are aligned with said plurality of head slots on the front face.

8. A refining member adapted for use in a refiner comprising a housing having a chamber, a material-admitting inlet and an outlet, two spaced apart coaxial refining members mounted in said chamber, with at least one refining meter rotatable relative to said other refining meter, and a path for the movement of material from maid inlet to said outlet, said two refining members including comminuting projections adjacent to said path to refine the material flowing along said path, said refining member being at least one of said two refining members and comprising a head having a front face and a rear face, said head front face having therein a plurality of head slots and said head rear face having therein a plurality of head slots, an outer circumferential edge, and a mounting hole spaced radially inwardly from said outer circumferential edge, a device outside of and attached to said head circumferential edge and extending beyond the head outer circumferential edge in the direction of axial rotation of the head, and a plurality of refiner plates, each of said refiner plates having an outer circumferential edge that abuts said device, a front surface having comminuting projections, and a plate rear surface, and a mounting opening radially inward from maid outer circumferential edge and aligned with said head mounting hole, said refiner plate including a radially extending key attached to said plate rear surface and received in a respective one of said plurality of head slots, said key having an end forming a tab that extends past said plate outer circumferential edge, said tab being held by said device, and a fastener extending through said plate mounting opening into said head mounting hole to removably secure said refining plate to said head.

9. A refining member in accordance with claim 8 wherein said plurality of head slots on the rear face are aligned with said plurality of head slots on the front face.

10. A refining number in accordance with claim 8 wherein said tab is releasably secured to said device.

11. A refining amber in accordance with claim 8 wherein each of said refiner plate has a single mounting opening.

12. A refining number in accordance with claim 8 wherein said mounting opening is radially inward from said comminuting projections.

13. A refiner plate having an outer circumferential edge, a front surface having comminuting projections, and a rear surface, and a single mounting opening radially inward from said outer circumferential edge and radially inward from said comminuting projections, said refiner plate including a radially extending key attached to said rear surface, said key having an end forming a tab that extends past said plate outer circumferential edge.

14. A refiner plate in accordance with claim 13 wherein said tab has a mounting opening therein.

* * * * *